US006005530A

United States Patent [19]

Jovanovich et al.

[11] Patent Number: 6,005,530

[45] Date of Patent: Dec. 21, 1999

[54] SWITCHED GAIN ANTENNA FOR ENHANCED SYSTEM PERFORMANCE

[75] Inventors: Alan F. Jovanovich, Des Moines; John W. Mensonides, Monroe; Bruce G. Warren, Poulsbo, all of Wash.

[73] Assignee: Intermec IP Corp., Woodland Hills, Calif.

[21] Appl. No.: 08/961,959

[22] Filed: Oct. 31, 1997

[51] Int. Cl.[6] ..... H01Q 21/10

[52] U.S. Cl. ..... 343/827; 343/790; 343/876

[58] Field of Search ..... 343/810, 792, 343/876, 745, 802, 813, 801, 790, 827; H01Q 9/16, 9/00, 3/24

[56] References Cited

U.S. PATENT DOCUMENTS

| | | | |
|---|---|---|---|
| 3,031,668 | 4/1962 | Bryson | 343/790 |
| 4,369,449 | 1/1983 | MacDougall | 343/790 |
| 4,554,554 | 11/1985 | Olesen et al. | 343/895 |
| 4,564,843 | 1/1986 | Cooper | 343/745 |
| 4,924,238 | 5/1990 | Ploussios | 343/802 |
| 5,140,336 | 8/1992 | Suomi | 343/790 |
| 5,541,609 | 7/1996 | Stutzman et al. | 343/792 |
| 5,548,813 | 8/1996 | Charas et al. | 455/33.3 |

FOREIGN PATENT DOCUMENTS 0 428 229 5/1991 European Pat. Off. .

2 759 497 8/1998 France .

OTHER PUBLICATIONS

Analysis of Coaxial Collinear Antenna: Recurrence Formula of Voltages and Admittances at Connections by Sakitani et al., IEEE Transactions On Antennas And Propagation, vol. 39, No. 1, Jan. 1991.

*Primary Examiner*—Michael C. Wimer
*Attorney, Agent, or Firm*—O'Melveny & Myers LLP

[57] ABSTRACT

A switched gain antenna array comprising a plurality of dipole elements disposed in series with a phasing stub coupled between adjacent ones of the dipole elements. An antenna feed line is coupled to a first one of the dipole elements to couple the RF signals into and out of the plurality of dipole elements. The phasing stubs are adapted to adjust phase of the RF signals provided to each of the dipole elements so that the dipole elements operate in phase. A switch is disposed between the first one of the dipole elements and a second one of the dipole elements. The switch is adapted to disconnect the first one of the dipole elements from remaining ones of the dipole elements during transmit operations of the antenna array and to connect each of the dipole elements together during receive operations of the antenna array. As a result, the antenna array has greater gain during receive operations than during transmit operations.

15 Claims, 3 Drawing Sheets

FIG. 4
PRIOR ART
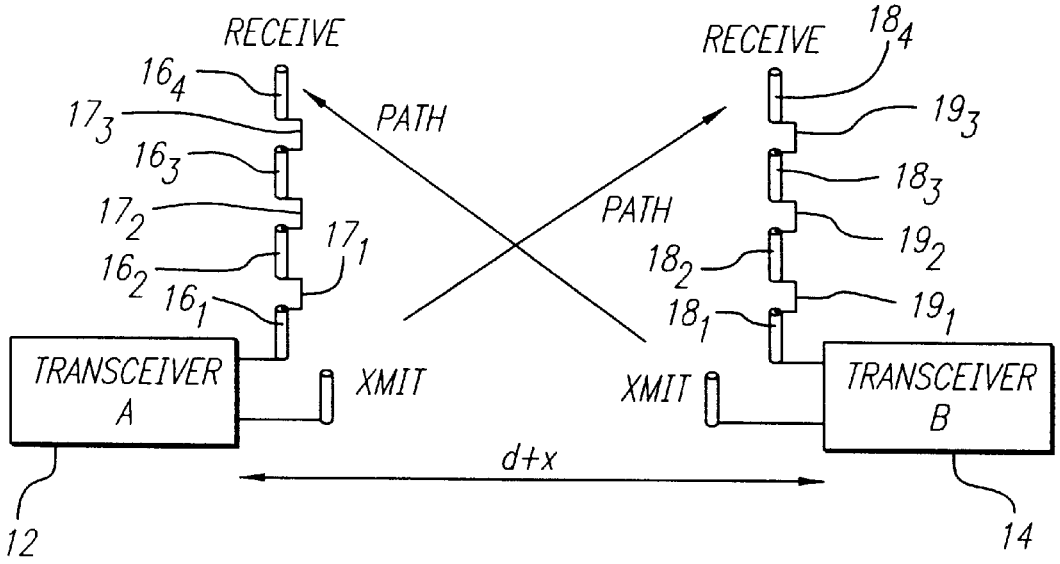
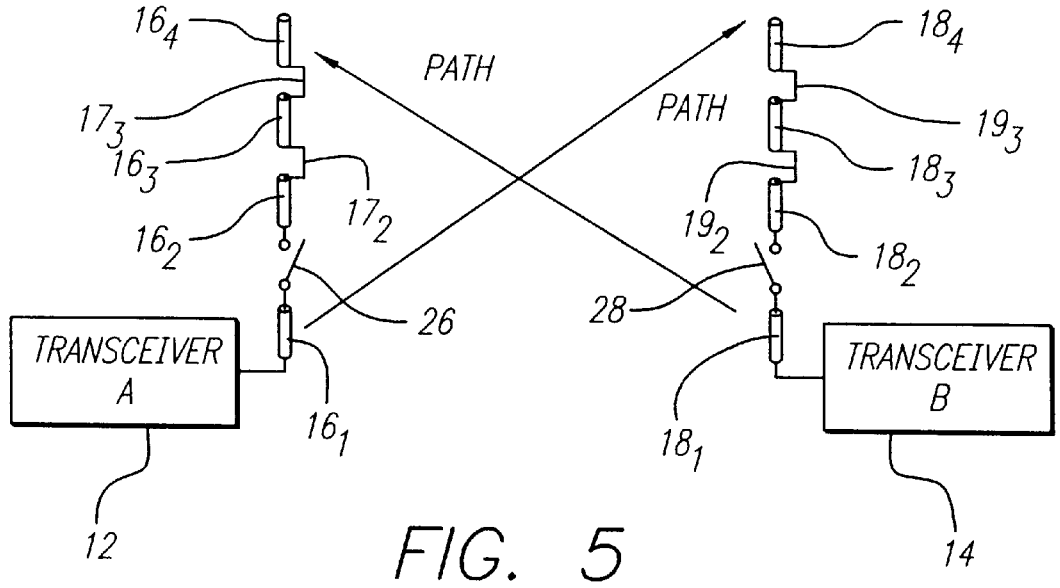
FIG. 5

SWITCHED GAIN ANTENNA FOR ENHANCED SYSTEM PERFORMANCE

BACKGROUND OF THE INVENTION

1. Field of the Invention

The present invention relates to wireless communication systems, and more particularly, to a collinear antenna array for a portable wireless communication device that permits enhanced system performance by increasing antenna gain without exceeding radiated power requirements.

2. Description of Related Art

Portable wireless communications systems are increasingly prevalent in the art as a convenient way to permit remote elements of a system to operate together. A particularly useful application of wireless communication is that of a wireless local area network (WLAN) in which a plurality of remote computing devices communicate together using radio frequency (RF) signals. The remote computing devices include a radio transceiver adapted for RF communication with each other as well as with the other elements of the WLAN. The WLAN may also include a central host processing unit, or network master, that sends information to and receives information from any one of the plurality of remotely disposed computing devices. Such WLAN systems offer increased flexibility over conventional wired LAN systems by enabling operators of the remote computing devices substantial freedom of movement through the environment, and may be found in diverse data collection applications such as inventory control, manufacturing and production flow management, and asset tracking.

A significant drawback of wireless communication systems is their limited range due in part to compliance with governmental communication regulations. In order to prevent interference between competing communications systems operating in the same general vicinity, governmental regulatory agencies limit the maximum amount of transmitted power from an RF transceiver. The limit in transmitted power tends to limit the operational range of the communication systems, which impairs the overall usefulness of the wireless communication system.

Currently, there are two methods under which regulatory agencies specify the maximum allowable output power. A first type of regulation specifies the maximum power (dBm/Hz of bandwidth) that can be sent from the transceiver to the antenna and/or to restrict the amount of gain that may be provided by the antenna. A second type of regulation specifies a maximum radiated power level measured at a predetermined distance from the transceiver. The European Telecommunications Standards Institute (ETSI) has adopted regulations under this second type of regulation. According to the ETSI regulations, for example, a maximum radiated power level of 20 dBm (100 mW) is permitted, and gain antennas may not be used to bring the signal level above the radiated power limit.

Thus, it would be highly desirable to provide a wireless communication system having a greater operational range without exceeding radiating power regulations.

SUMMARY OF THE INVENTION

In accordance with the teachings of the present application, a switched gain antenna array is provided for transmitting and receiving radio frequency (RF) signals within a selected frequency band. The switched gain antenna array permits increased antenna gain without exceeding radiated power regulations.

Specifically, the switched gain antenna array comprising a plurality of dipole elements disposed in series with a phasing stub coupled between adjacent ones of the dipole elements. An antenna feed line is coupled to a first one of the dipole elements to couple the RF signals into and out of the plurality of dipole elements. The phasing stubs are adapted to adjust phase of the RF signals provided to each of the dipole elements so that the dipole elements operate in phase. A switch is disposed between the first one of the dipole elements and a second one of the dipole elements. The switch is adapted to disconnect the first one of the dipole elements from remaining ones of the dipole elements during transmit operations of the antenna array and to connect each of the dipole elements together during receive operations of the antenna array. As a result, the antenna array has increased gain only during receive operations.

A more complete understanding of the switched gain antenna will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 4 is a schematic diagram of a prior art wireless communication system with a transmit antenna comprising a single dipole element and a receive antenna comprising plural collinear dipole elements arranged in an array;

FIG. 5 is a schematic diagram of a wireless communication system of the present invention having a switched gain antenna comprising plural collinear dipole elements arranged in an array with the first dipole element separated from the remaining dipole elements by an antenna gain switch;

DETAILED DESCRIPTION OF THE PREFERRED EMBODIMENT

The present invention provides a switched gain antenna that satisfies the need for a wireless communication system having a greater operational range without exceeding radiating power regulations. In the detailed description that follows, it should be appreciated that like element numerals are used to describe like elements illustrated in one or more of the figures.

Figure 1:
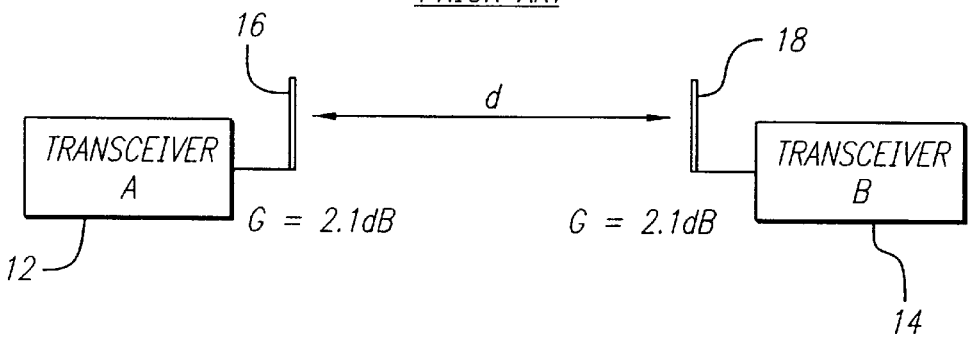
FIG. 1 PRIOR ART
FIG. 1 is a schematic diagram of a prior art wireless communication system having single dipole elements.

Referring first to FIG. 1, a schematic diagram of an exemplary prior art wireless communication system is illustrated. A first transceiver 12 is communicating with a second transceiver 14 using radio frequency (RF) signals within a selected frequency band. The first transceiver is coupled through a feed line to a single element dipole antenna 16, and the second transceiver is coupled through a feed line to a single element dipole antenna 18. To satisfy the 20 dBm radiated power limit defined by the ETSI regulations, the output power of each of the transceivers must be reduced by the gain of the antennas. By way of example, each of the dipole antennas 16, 18 provide 2.1 dB gain (G), which results in a maximum allowable power output from the transceivers of 17.9 dBm. The distance (d) between the antennas 16, 18, or range of the transceivers, is dependent on the power output, the antenna gain, and the quality of the transceivers. In this exemplary wireless communication system, it will be assumed that the quality of the two transceivers 12, 14 is equal and the antennas 16, 18 are each used bidirectionally, permitting transmission of signals to and from the respective transceivers.

Figure 2:
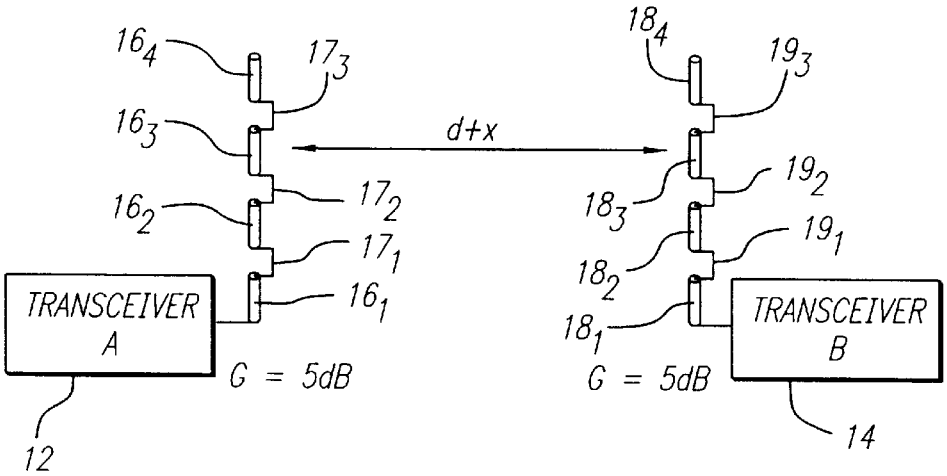
FIG. 2 PRIOR ART
FIG. 2 is a schematic diagram of a prior art wireless communication system having plural collinear dipole elements arranged in an array.

The performance of the exemplary wireless communication system can be substantially improved, as shown in FIG. 2, by using antennas having higher gain. Instead of single dipole element antennas, the first and second transceivers 12, 14 have collinear antenna arrays comprised of multiple dipole elements $\mathbf{16}_1$–$\mathbf{16}_4$, $\mathbf{18}_1$–$\mathbf{18}_4$ that are arranged along a common linear axis. As known in the art, each one of the dipole elements $\mathbf{16}_1$–$\mathbf{16}_4$, $\mathbf{18}_1$–$\mathbf{18}_4$ has a length equal to one-half of a wavelength ($\lambda/2$) of the RF signals communicated in the system. The adjacent ones of the dipole elements $\mathbf{16}_1$–$\mathbf{16}_4$, $\mathbf{18}_1$–$\mathbf{18}_4$ are separated by phasing stubs $\mathbf{17}_1$–$\mathbf{17}_3$, $\mathbf{19}_1$–$\mathbf{19}_3$, which serve to ensure that each of the dipole elements are driven in phase. By driving the multiple dipole elements in phase, a linearly polarized omnidirectional transmission pattern is provided from each antenna. In the example of FIG. 2, the collinear antennas $\mathbf{16}_1$–$\mathbf{16}_4$, $\mathbf{18}_1$–$\mathbf{18}_4$ each have gain of 5 dB, which serves to increase the range of the transceivers over that of the first example (d+x); however, the radiated power limit is exceeded if the transceivers 12, 14 remain the same.

Figure 3:
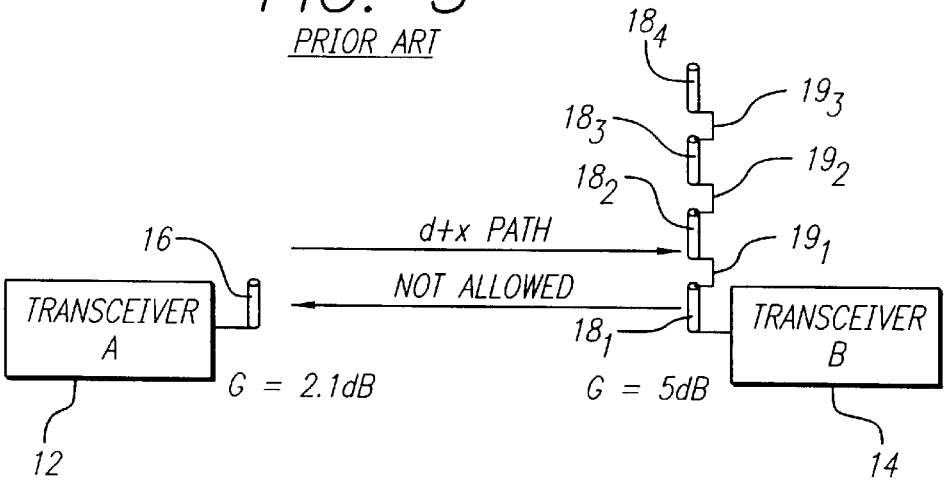
FIG. 3 PRIOR ART
FIG. 3 is a schematic diagram of a prior art wireless communication system with one transceiver having a single dipole element and a second transceiver having plural collinear dipole elements arranged in an array.

FIG. 3 illustrates a prior art hybrid system that provides higher gain in one direction without exceeding the radiated power limits. As in FIG. 1, first transceiver 12 has a single element dipole antenna 16 that provides 2.1 dB gain. As in FIG. 2, the second transceiver 14 has a collinear antenna array comprised of multiple dipole elements $\mathbf{18}_1$–$\mathbf{18}_4$ arranged along a common linear axis, with adjacent ones of the dipole elements separated by phasing stubs $\mathbf{19}_1$–$\mathbf{19}_3$, to provide 5 dB of gain. By operating the first transceiver 12 in transmit mode only, and the second transceiver 14 in receive mode only, the range of the wireless communication system is increased to that of the second example (d+x) without exceeding the radiated power limits. If the second transceiver 14 is operated in transmit mode, however, the radiated power limits will be exceeded. Accordingly, this particular embodiment would not be practical for two way communications, such as in a WLAN.

The prior art wireless communication system of FIG. 4 further combines the attributes of the preceding examples. Both of the transceivers use a single element dipole antenna for transmit operations and a collinear antenna array for receive operations. More particularly, the first transceiver 12 has a single element dipole transmit antenna 22 that provides 2.1 dB gain and a multiple dipole receive antenna having elements $\mathbf{16}_1$–$\mathbf{16}_4$ arranged along a common linear axis, with adjacent ones of the dipole elements separated by phasing stubs $\mathbf{17}_1$–$\mathbf{17}_3$, to provide 5 dB of gain. Similarly, the second transceiver 14 has a single element dipole transmit antenna 24 and a multiple dipole receive antenna having elements $\mathbf{18}_1$–$\mathbf{18}_4$ separated by phasing stubs $\mathbf{19}_1$–$\mathbf{19}_3$. The range of this wireless communication system is again increased to that of the second example (d+x) without exceeding the radiated power limits. Nevertheless, the use of separate antennas for receive and transmit substantially increase the cost and complexity of the wireless communication system.

The wireless communication system of the present invention achieves the desirable range attributes of the previous embodiment without the undesirable drawbacks. As shown in FIG. 5, the first and second transceivers 12, 14 have collinear antenna arrays like the preceding embodiments comprised of multiple dipole elements $\mathbf{16}_1$–$\mathbf{16}_4$, $\mathbf{18}_1$–$\mathbf{18}_4$ separated by phasing stubs $\mathbf{17}_2$–$\mathbf{17}_3$, $\mathbf{19}_2$–$\mathbf{19}_3$. Unlike the previous embodiments, an antenna gain switch 26, 28 is coupled between the first and second ones of the dipole elements $\mathbf{16}_1$, $\mathbf{16}_2$ and $\mathbf{18}_1$, $\mathbf{18}_2$. The first ones of the phasing stubs 17, $\mathbf{19}_1$ are not illustrated in FIG. 5, but it should be appreciated that it is necessary to introduce a phase delay between first and second dipole elements in order to maintain proper operation of the collinear antenna arrays. It is anticipated that the switches 26, 28 operate as phasing stubs for this purpose. During receive operations, the switches 26, 28 will be closed so that the collinear antennas $\mathbf{16}_1$–$\mathbf{16}_4$, $\mathbf{18}_1$–$\mathbf{18}_4$ each have gain of 5 dB for increased range (d+x). Conversely, during transmit operations, the switches will be open to disconnect the first ones of the dipole elements $\mathbf{16}_1$, $\mathbf{18}_1$ from the remaining dipole elements so that the antennas operate as single element dipoles having gain of only 2.1 dB. Accordingly, the present wireless communication system obtains greater transmitting range without exceeding the radiated power regulations or increasing the number of antennas.

Figure 6:
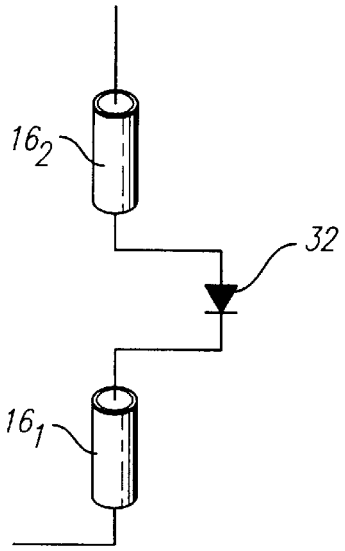
FIG. 6 is a schematic diagram of a portion of the wireless communication system of FIG. 5, illustrating a first embodiment of the antenna gain switch.
Figure 7:
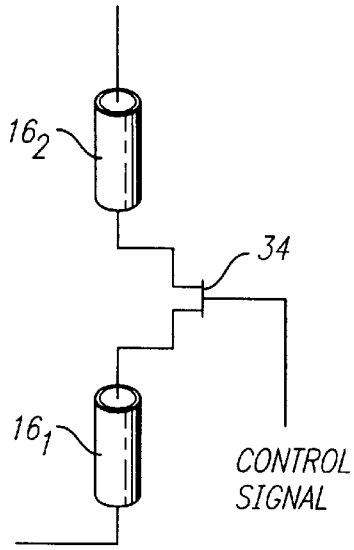
FIG. 7 is a schematic diagram of a portion of the wireless communication system of FIG. 5, illustrating a second embodiment of the antenna gain switch.
Figure 8:
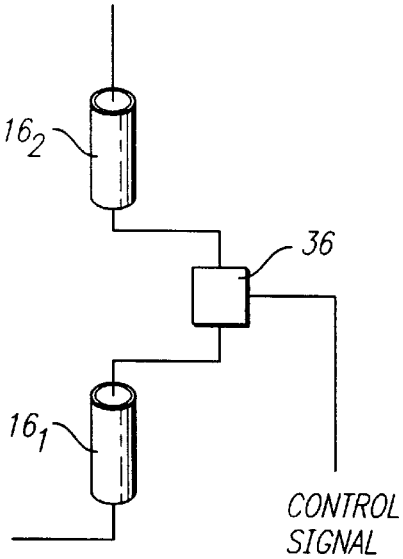
FIG. 8 is a schematic diagram of a portion of the wireless communication system of FIG. 5, illustrating a third embodiment of the antenna gain switch.

The antenna gain switches 26, 28 of FIG. 5 may be implemented in various alternative ways, as shown in FIGS. 6–8. A first embodiment of the switch is illustrated in FIG. 6, utilizing a pin diode 32 biased to permit RF current to flow only from the second dipole element $\mathbf{16}_2$ to the first dipole element $\mathbf{16}_1$, and not in the reverse direction. This way, only the first dipole element $\mathbf{16}_1$ will radiate during transmit operations, but all dipole elements $\mathbf{16}_1$–$\mathbf{16}_4$ will be active during receive operations.

A second embodiment of the switch is illustrated in FIG. 7, utilizing a field effect transistor (FET) 34 with the source and drain coupled to the second dipole element $\mathbf{16}_2$ and the first dipole element $\mathbf{16}_1$, respectively. The gate of the FET 34 is driven by a control signal to cause the FET to conduct only during receive operations. The control signal may be provided by the transceiver either through the feed line or other external line. Similarly, a third embodiment of the switch is illustrated in FIG. 8, utilizing an RF relay 36 coupled between the first dipole element $\mathbf{16}_1$ and the second dipole element $\mathbf{16}_2$. As with the FET 34, the relay 36 is driven by a control signal to cause the relay to conduct only during receive operations. It should be appreciated that other types of solid state or electromagnetic switches may also be advantageously utilized in a similar manner.

It is anticipated that the present switched gain antenna be operated within the UHF frequency band, in which the individual dipole elements are small enough to be directly patterned onto a printed circuit board of the transceiver. For such an application, it should be appreciated that an impedance matching network (not shown) be utilized to match the impedance between the transceiver circuitry, the feed line and the antennas for the particular frequency band. Moreover, a current return path must also be provided from the dipole elements back to the impedance matching network. These aspects of a communication system are well known in the art, and further description herein is therefor omitted. It should also be appreciated that the present switched gain antenna may be employed in any other type of RF communication system, or any other frequency range, in which it is desirable to limit maximum radiated power.

Having thus described a preferred embodiment of a switched gain antenna, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An antenna array for transmitting and receiving radio frequency (RF) signals within a selected frequency band, comprising:

a plurality of dipole elements disposed in series with a phasing stub coupled between adjacent ones of said dipole elements;

an antenna feed line coupled to a first one of said dipole elements to couple said RF signals into and out of said plurality of dipole elements, said phasing stubs being adapted to adjust phase of said RF signals provided to each of said dipole elements so that said dipole elements operate in phase; and a switch disposed between said first one of said dipole elements and a second one of said dipole elements, said switch being adapted to disconnect said first one of said dipole elements from remaining ones of said dipole elements during transmit operations of said antenna array and to connect each of said dipole elements together during receive operations of said antenna array.

2. The antenna array of claim 1, wherein said switch further comprises a field effect transistor.

3. The antenna array of claim 1, wherein said switch further comprises an RF relay.

4. The antenna array of claim 1, wherein said switch further comprises a pin diode.

5. The antenna array of claim 1, wherein each of said plurality of dipole elements have a length approximately equal to one-half of a wavelength of said RF signals.

6. The antenna array of claim 1, wherein said plurality of dipole elements are aligned linearly.

7. An antenna array for transmitting and receiving radio frequency (RF) signals comprising:

a plurality of dipole elements disposed in series;

phasing means disposed between adjacent ones of said dipole elements for maintaining each of said dipole elements in phase;

feeding means for feeding said RF signals into at least one of said dipole elements; and connecting means, disposed between said at least one of said dipole elements and remaining ones of said dipole elements, for connecting said at least one of said dipole elements to said remaining ones of said dipole elements during receive operations of said antenna array, said at least one of said dipole elements being disconnected from said remaining ones of said dipole elements during transmit operations of said antenna array.

8. The antenna array of claim 7, wherein said connecting means further comprises a switch.

9. The antenna array of claim 7, wherein said connecting means further comprises a field effect transistor.

10. The antenna array of claim 7, wherein said connecting means further comprises an RF relay.

11. The antenna array of claim 7, wherein said connecting means further comprises a pin diode.

12. The antenna array of claim 7, wherein each of said plurality of dipole elements have a length approximately equal to one-half of a wavelength of said RF signals.

13. The antenna array of claim 7, wherein said plurality of dipole elements are aligned linearly.

14. The antenna array of claim 7, wherein said phasing means further comprises a phasing stub.

15. The antenna array of claim 7, wherein said feeding means further comprises a transmission line.

* * * * *